US009347294B2

(12) United States Patent
Gramstad

(10) Patent No.: US 9,347,294 B2
(45) Date of Patent: May 24, 2016

(54) METHOD AND ARRANGEMENT FOR ESTABLISHING AND OPERATING A RISER LESS COILED TUBING

(75) Inventor: Bernt Gramstad, Algard (NO)

(73) Assignee: Agat Technology AS, Stavanger (NO)

( * ) Notice: Subject to any disclaimer, the term of this patent is extended or adjusted under 35 U.S.C. 154(b) by 66 days.

(21) Appl. No.: 14/117,339

(22) PCT Filed: May 23, 2012

(86) PCT No.: PCT/NO2012/050096

§ 371 (c)(1),
(2), (4) Date: May 2, 2014

(87) PCT Pub. No.: WO2012/161587

PCT Pub. Date: Nov. 29, 2012

(65) Prior Publication Data

US 2014/0290961 A1 Oct. 2, 2014

Related U.S. Application Data

(60) Provisional application No. 61/490,335, filed on May 26, 2011.

(30) Foreign Application Priority Data

May 26, 2011 (NO) ..... 20110770

(51) Int. Cl.

| | |
|---|---|
| ***E21B 19/22*** | (2006.01) |
| ***E21B 29/12*** | (2006.01) |
| ***E21B 7/12*** | (2006.01) |
| ***E21B 43/013*** | (2006.01) |
| ***E21B 19/00*** | (2006.01) |

(52) U.S. Cl.

CPC ..... *E21B 43/013* (2013.01); *E21B 19/002* (2013.01); *E21B 19/22* (2013.01)

(58) Field of Classification Search

None

See application file for complete search history.

(56) References Cited

U.S. PATENT DOCUMENTS

| | | | |
|---|---|---|---|
| 4,923,005 | A | 5/1990 | Laky et al. |
| 6,276,454 | B1 | 8/2001 | Fontana et al. |

(Continued)

FOREIGN PATENT DOCUMENTS

| | | | |
|---|---|---|---|
| GB | 2 343 466 | A | 5/2000 |
| WO | 2004/003338 | A1 | 1/2004 |
| WO | 2012/106452 | A2 | 8/2012 |

OTHER PUBLICATIONS

International Search Report for parent application PCT/NO2012/050096, having a mailing date of Aug. 23, 2012.

(Continued)

*Primary Examiner* — Matthew R Buck
*Assistant Examiner* — Douglas S Wood
(74) *Attorney, Agent, or Firm* — Andrus Intellectual Property Law, LLP

(57) ABSTRACT

A method and system are for establishing and operating a riser less coiled tubing intervention arrangement from a surface vessel, the vessel having a deck and a coiled tubing reel holding a coiled tubing, and where a subsea injector is connectable to a head of a subsea borehole. The method includes: arranging; the coiled tubing in a surface injector and the subsea injector, attaching, the surface injector to a lifting tackle of the vessel; after connecting a tool string to the coiled tubing, lowering the coiled tubing tool string and the subsea injector through the sea to the head by running the surface injector while paying out coiled tubing from the coiled tubing reel; and inserting, the tool string in the head and connecting the subsea injector to the head.

3 Claims, 5 Drawing Sheets

(56) References Cited

U.S. PATENT DOCUMENTS

| | | | | |
|---|---|---|---|---|
| 6,868,902 | B1 * | 3/2005 | Roodenburg et al. | 166/77.2 |
| 8,720,582 | B2 * | 5/2014 | Portman | E21B 19/22 166/344 |
| 2008/0230228 | A1 | 9/2008 | Askeland | |

OTHER PUBLICATIONS

Written Opinion for parent application PCT/NO2012/050096, having a mailing date of Aug. 23, 2012.

* cited by examiner

METHOD AND ARRANGEMENT FOR ESTABLISHING AND OPERATING A RISER LESS COILED TUBING

CROSS-REFERENCE TO RELATED APPLICATIONS

This application is the U.S. national stage application of International Application No. PCT/NO2012/050096, filed May 23, 2012, which International application was published on Nov. 29, 2012 as International Publication No. WO 2012/161587 A1 in the English language and which application is incorporated herein by reference. The International application claims priority of Norwegian Patent Application No. 20110770, filed May 26, 2011, and U.S. Patent Application No. 61/490,335, filed May 26, 2011, which applications are incorporated herein by reference.

There is provided a method for establishing and operating a riser less coiled tubing. More precisely, there is provided a method for establishing and operating a riser less coiled tubing intervention arrangement from a surface vessel, the vessel having a deck and a coiled tubing reel holding a coiled tubing, and where a subsea injector is connectable to a head of a subsea borehole. The invention also includes an arrangement for practising the method.

The method and device of this document is well suited for, but not limited to use in a petroleum well.

From time to time it is necessary to undertake maintenance or upgrading work for instance in petroleum wells. A coiled tubing system is often used for this purpose. When such intervention work is to be done in a well having the well head on the sea floor, the coiled tubing has, according to well known practice, been guided to the wellhead through a marine riser or a high pressure workover riser from a semi-submergible vessel. Alternatively, a workover riser from a monohull vessel has been utilized.

Although these methods provide the well owner with reliable methods for the work to be done, it also includes heavy and costly equipment for doing relatively light work.

The purpose of the invention is to overcome or reduce at least one of the disadvantages of the prior art.

The purpose is achieved according to the invention by the features disclosed in the description below and in the following patent claims.

There is provided a method for establishing and operating a riser less coiled tubing intervention arrangement from a surface vessel, the vessel having a deck and a coiled tubing reel holding a coiled tubing, and where a subsea injector is connectable to a head of a subsea borehole, wherein the method includes:

- arranging the coded tubing in a surface injector and the subsea injector;
- attaching the surface injector to a lifting tackle of the vessel;
- after connecting a tool string to the coded tubing, lowering the coded tubing tool string and the subsea injector through the sea to the head by running the surface injector while paying out coiled tubing from the coded tubing reel;
- inserting the tool string in the head and connecting the subsea injector to the head.

The term "head" is here used to denote equipment of a subsea borehole present on or close to the sea floor. As is obvious to a person skilled in the art, if the head is positioned on a well, the head is termed a "well head" and this may typically include a subsea tree and a blow out preventer, as well as equipment designed for intervention work.

The term "surface injector" indicates that this injector is normally kept above the water line. There may be operations when also this injector at least temporarily may be immersed.

The reel may have a separate feeder for paying coiled tubing in and out to and from the reel. The coiled tubing may be made from any suitable material, for instance metal or composite. The term "injector" is not limited to injectors as supplied by present suppliers, but includes any type of usable feeders.

The method may further include switching the lifting tackle to a passive constant tension mode after the subsea injector is connected to the head.

In this way a constant tension force may be applied on the coiled tubing for instance in order to keep the coiled tubing within allowable bending limits at its entry position at the subsea injector.

The method may further include keeping the coiled tubing between the coiled tubing reel and the surface injector slack. By doing so a substantially more accurate tension load is applied to the coiled tubing in the sea as the load from the lifting tackle is directly applied to said part of the coiled tubing via the surface injector.

The method may further include letting movement of the surface injector relative to the vessel compensate for heave motion of the vessel. The continuous paying out and in of coiled tubing from and into the coiled tubing reel is thus largely avoided.

The method may be carried out by use of an arrangement for establishing and operating a riser less intervention system from a surface vessel, the vessel having a deck and a coiled tubing reel holding a coiled tubing, and where a subsea injector is connectable to a head of a subsea borehole, wherein the coil tubing is running through a surface injector that is located between the coiled tubing reel and the sub surface injector.

The surface injector may thus take over the pre-tensioned running inn and out of the vertical part of the coil tubing that is normally allocated to the coiled tubing reel. The pre-tension of the coiled tubing reel is then adapted to maintain a suitable stretch in the coiled tubing between the coiled tubing reel and the surface injector.

The surface injector may be movable in the vertical direction. Thus the movement of the surface injector may compensate for the heave movement of a single hull vessel that is larger than on a semi-submergible vessel.

The surface injector may be connected to a lifting tackle of a vessel. Such lifting tackle may in addition to the normal lifting mode have a mode for active heave compensation and a mode for passive compensation where the load is kept constant.

The vessel may have a moon pool and a derrick. The coiled tubing may pass through the moon pool and the surface injector may be movable in the derrick.

All equipment except for the surface injector is well known and readily available from sources well known to a skilled person. The surface injector is designed to handle the coiled tubing similarly as known injectors.

The method and arrangement according to the invention provide a simplified and thus cost effective way of intervening in subsea boreholes. The stress on the coiled tubing is reduced as the heave compensation is taken by the movement of the surface injector. Further, the necessary tension in the submerged part of the coiled tubing is kept at an accurate level.

Below, an example of a preferred method and arrangement is explained under reference to the enclosed drawings, where:

Figure 1:
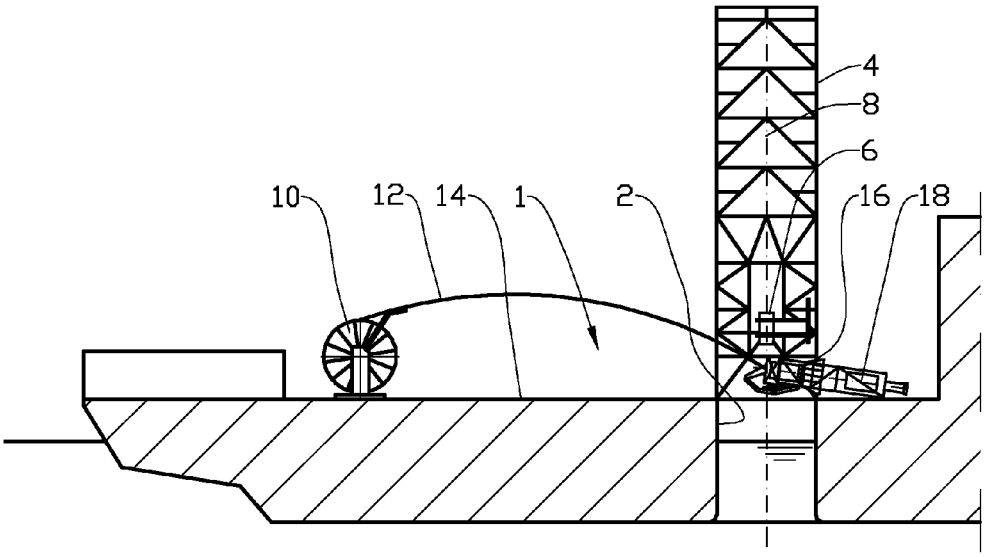
FIG. 1 shows a simplified sketch of an arrangement according to the invention where an surface and a subsea injector are positioned on a deck of a vessel.

On the drawings the reference number 1 denotes a monohull vessel having a moonpool 2 and a derrick 4 including a cursor 6 and lifting tackle 8.

A coiled tubing reel 10 having a coiled tubing 12 is positioned on a deck 14 of the vessel 1.

Figure 2:
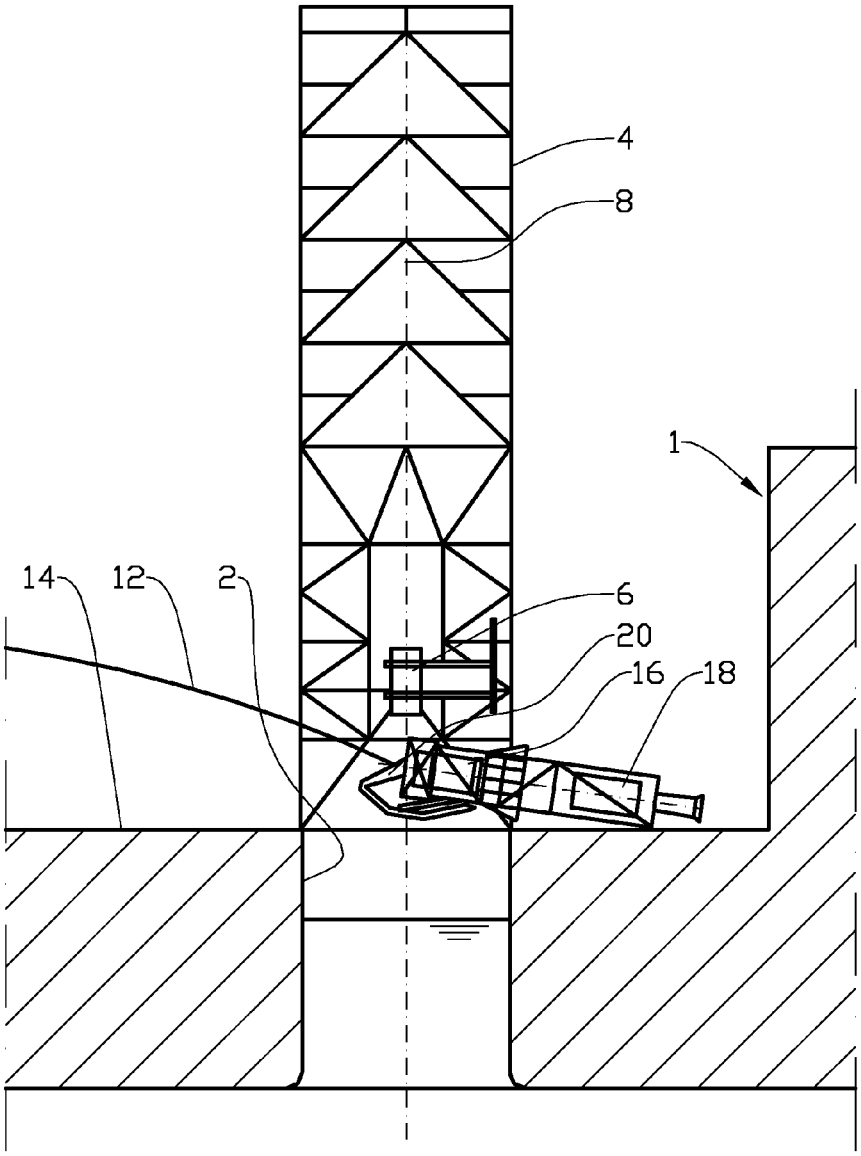
FIG. 2 shows to a larger scale a section from FIG. 1.

In FIGS. 1 and 2 the coiled tubing is inserted in a surface injector 16 and a subsea injector 18 that at this stage is connected to the surface injector 16.

The injectors 16, 18 are then lifted and connected to the cursor 6 while a collapsible gooseneck 20 is extended in order to support the coiled tubing 12 running to the coiled tubing reel 10.

The cursor 6 that is connected to the lifting tackle 8 is vertically movable along not shown guides in the derrick. The not shown guides may extend into the moonpool 2.

Figure 3:
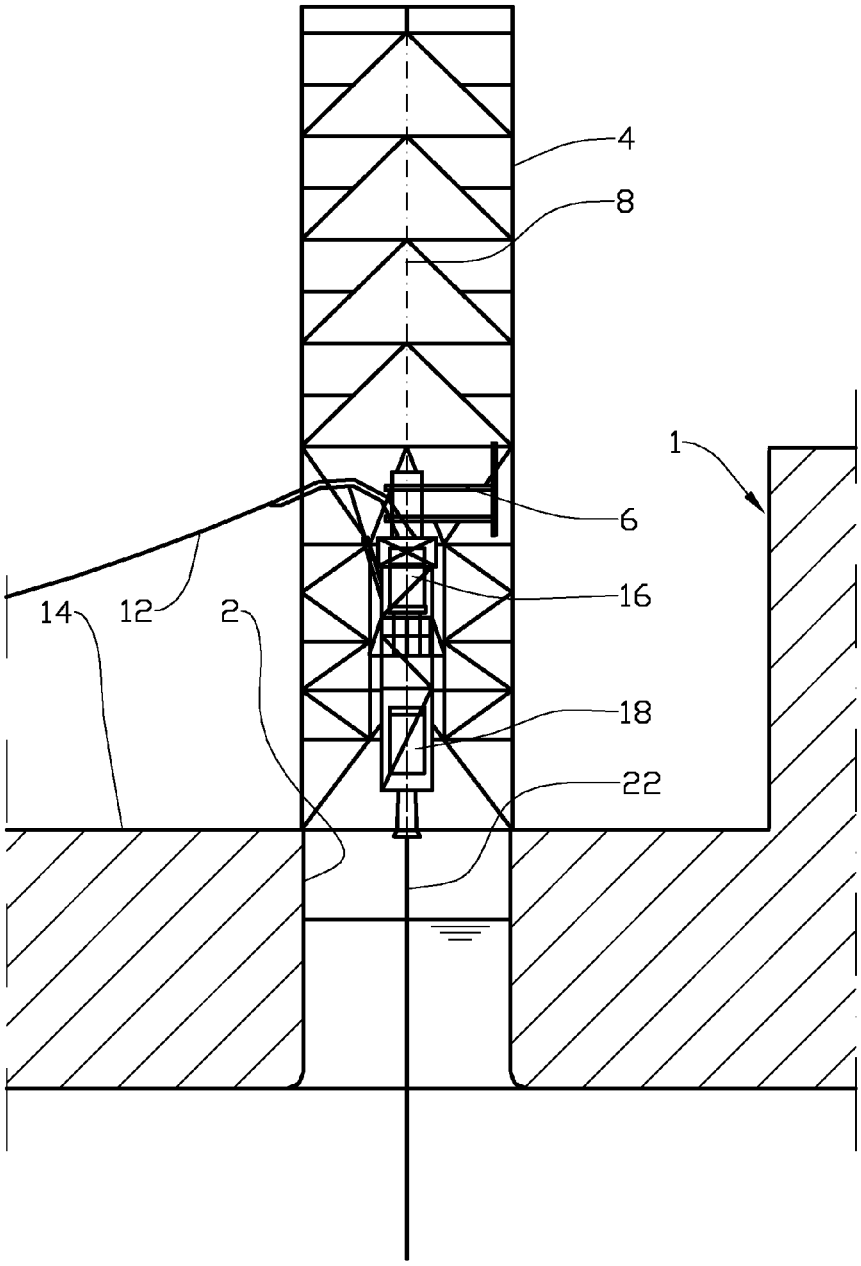
FIG. 3 shows the same as in FIG. 2, but here the injectors are connected to a cursor of the vessel.
Figure 4:
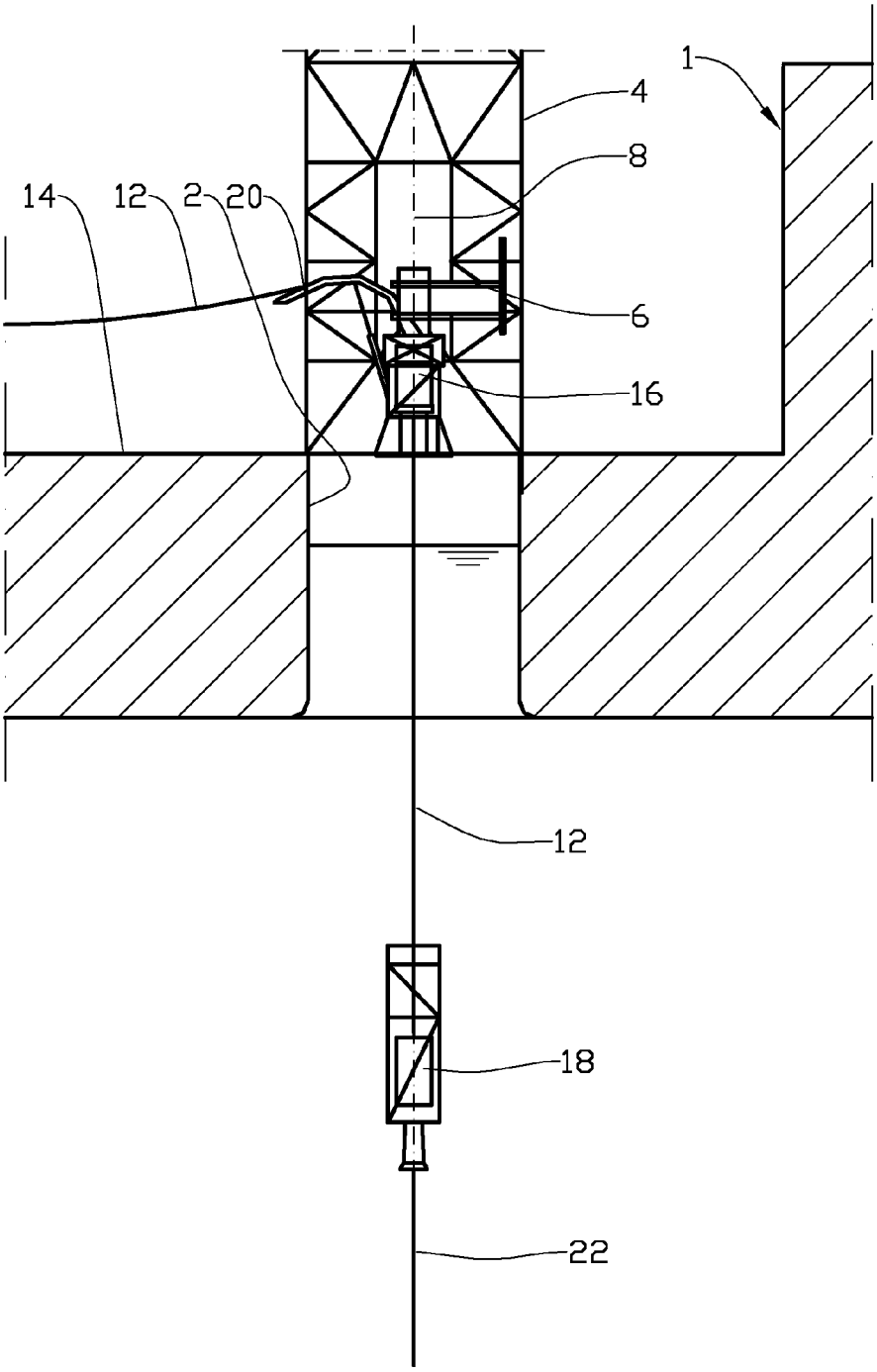
FIG. 4 shows the same as in FIG. 3, but here the subsea injector and an attached coil tubing work string is lowered into the sea.

With the injectors 16, 18 lifted to the position shown in FIG. 3, a coiled tubing tool string 22 is connected to the coiled tubing 12 at a position below the subsea injector 18.

Thereafter the subsea injector 18 is released from the surface injector 16. The coiled tubing 12 is then feed out by the surface injector 16, thereby lowering the subsea injector 18 and tool string 22 into the sea.

Figure 5:
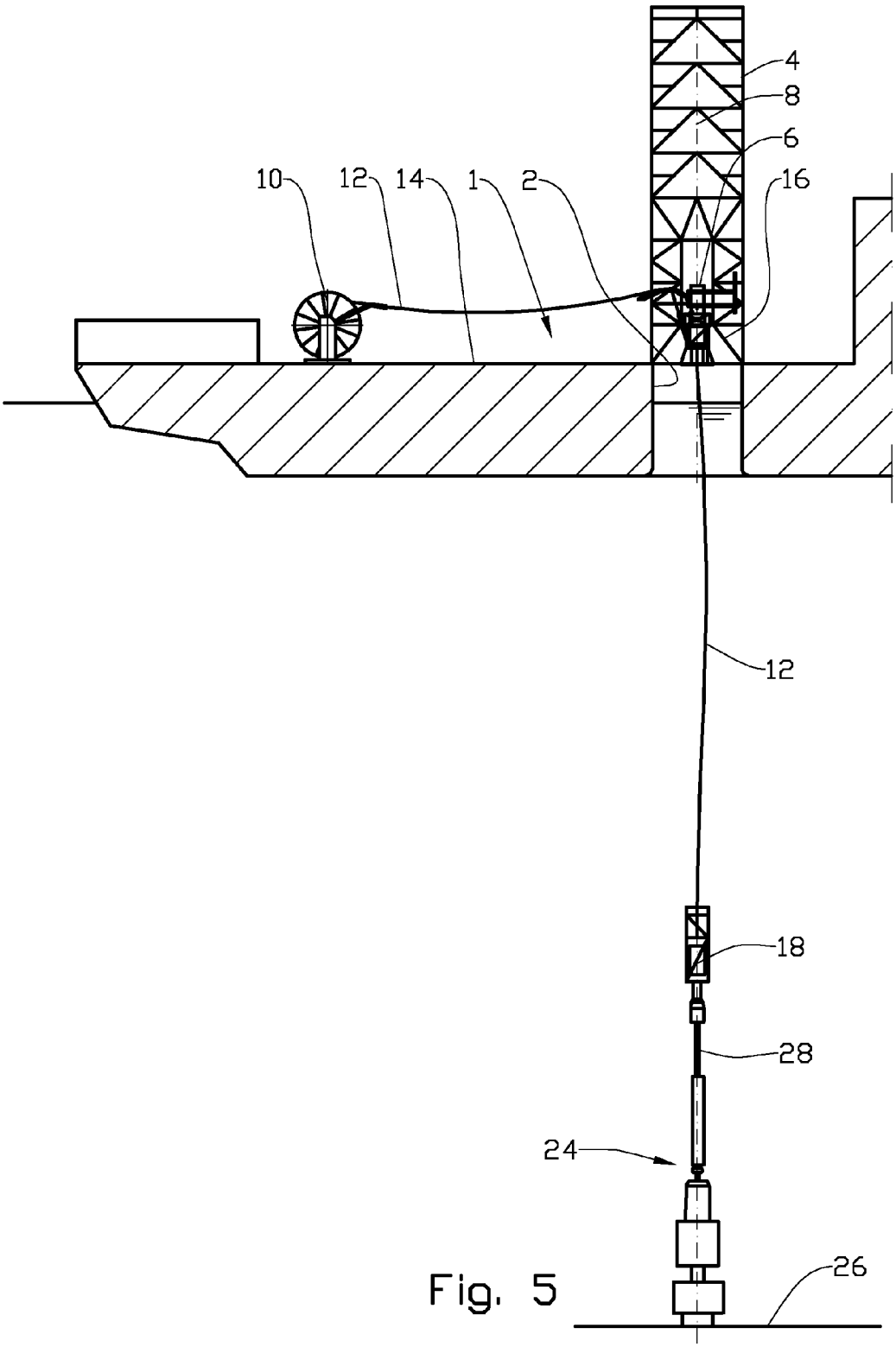
FIG. 5 shows to a smaller scale the arrangement after the subsea injector is connected to a head.

When the subsea injector 18 and tool string 22 are approaching a head 24 on the sea bed 26, or in this case more precisely intervention equipment 28, the lifting tackle 8 is changed into active heave compensated lifting mode, whereby the subsea injector 18 by the help of a not shown remote operated vehicle may be safely located and fixed to the intervention equipment 28, see FIG. 5.

The subsea injector 18 may now feed the coiled tubing 12 through the head 24 while the surface injector 16 is feeding the required rate of coiled tubing 12 while, as the mode of the lifting tackle 8 is changed to passive constant tension, keeping a constant tension in the submerged part of the coiled tubing 12.

Disconnecting the subsea injector 18 from the intervention equipment 28 may be undertaken in reversed order of the method as described above.

Necessary cables and equipment for energy supply and control is not shown as it will be known to a skilled person.

The invention claimed is:

1. A method for establishing and operating a riser less coiled tubing intervention arrangement from a surface vessel, the vessel having a deck and a coiled tubing reel holding a coiled tubing, and where a subsea injector is connectable to a head of a subsea borehole, the method comprising:

arranging the coiled tubing in a surface injector and the subsea injector;

attaching the surface injector to a lifting tackle of the vessel;

after connecting a tool string to the coiled tubing, lowering the coiled tubing tool string and the subsea injector through the sea to the head by running the surface injector while paying out coiled tubing from the coiled tubing reel;

inserting the tool string in the head and connecting the subsea injector to the head while operating the lifting tackle in an active heave compensated lifting mode; and during operation of the active heave compensated lifting mode, switching the lifting tackle from the active heave compensated lifting mode to a passive constant tension mode just after the subsea injector is connected to the head to thereby apply a constant tension force on the coiled tubing and keep the coiled tubing within bending limits at an entry position of the coiled tubing at the subsea injector; and thereafter switching the lifting tackle from the passive constant tension mode back to the active heave compensated lifting mode just after the subsea injector is disconnected from the head.

2. A method according to claim 1, wherein the method further comprises keeping the coiled tubing that is positioned between the coiled tubing reel and the surface injector slack.

3. A method according to claim 1, wherein the method further comprises letting movement of the surface injector relative the vessel compensate for heave motion of the vessel.

* * * * *